US007377826B1

(12) United States Patent
Wengren, Jr.

(10) Patent No.: US 7,377,826 B1
(45) Date of Patent: May 27, 2008

(54) FOULING REMOVAL SYSTEM FOR JET DRIVE WATER INTAKE

(76) Inventor: Richard E. Wengren, Jr., 30 Main St., P.O. Box 19, South Freeport, ME (US) 04078

( * ) Notice: Subject to any disclaimer, the term of this patent is extended or adjusted under 35 U.S.C. 154(b) by 0 days.

(21) Appl. No.: 11/769,972

(22) Filed: Jun. 28, 2007

Related U.S. Application Data

(60) Provisional application No. 60/871,197, filed on Dec. 21, 2006.

(51) Int. Cl.
*B63H 11/103* (2006.01)

(52) U.S. Cl. ..... 440/46; 440/38; 440/47

(58) Field of Classification Search ..... 440/38, 440/46, 47
See application file for complete search history.

(56) References Cited

U.S. PATENT DOCUMENTS

| | | | | |
|---|---|---|---|---|
| 3,094,965 | A * | 6/1963 | Burgin | 440/46 |
| 3,109,407 | A * | 11/1963 | Dorst | 440/46 |
| 5,468,165 | A | 11/1995 | Weber et al. | |
| 5,505,639 | A * | 4/1996 | Burg | 440/42 |
| 5,577,941 | A | 11/1996 | Chartier | |
| 5,876,258 | A | 3/1999 | Gray | |
| 6,033,272 | A | 3/2000 | Whiteside | |
| 6,045,418 | A | 4/2000 | Roos | |
| 6,083,063 | A | 7/2000 | Neisen | |
| 6,183,319 | B1 | 2/2001 | Ishigaki | |
| 6,482,055 | B1 | 11/2002 | Freitag | |

OTHER PUBLICATIONS

Husick, Chuck, Going Propless: Water-jet drives, long a curiosity, are now turning up on almost everything, Yachting Magazine, Sep. 2005, www.yachtingmagazine.com, 2pp.
Wilkinson, Stephan, Hand-Built, Wood-Trimmed, Jet-Powered, Popular Science, Mar. 2004, www.popsci.com, 2pp.
Hydro Surge Grate For Merc Jet Drive, Boating Forum, www.forums.iboats.com, 2pp.
HydroSurge Weedless Grate . . . Not So Great!, JetBoater's Forum, www.network54.com, 14pp.

* cited by examiner

*Primary Examiner*—Ed Swinehart
(74) *Attorney, Agent, or Firm*—Verrill Dana, LLP; Chris A. Caseiro; Brian J. Libby

(57) ABSTRACT

A fouling removal system for use in a water-jet drive system is described. The fouling removal system includes a cutter arm assembly and an optional cutter stud. The cutter arm assembly includes a pivotable cutting blade located adjacent to the intake grate and arranged to sever any debris, such as seaweed and eel grass, clogging the intake grate. The cutter arm assembly may be tied into existing watercraft hydraulic systems to use a hydraulic cylinder to cause movement of the cutting blade across the surface of the intake grate. The optional cutter stud is located adjacent to the impeller within the water-jet drive system housing. The cutter stud acts to sever debris associated with the impeller blades, which, if left on the blades, would reduce the efficiency of the impeller. The present fouling system is capable of removing debris from the intake grate and impeller of a water-jet drive while a watercraft is stationary or is operating at any speed, including full speed.

20 Claims, 3 Drawing Sheets

FOULING REMOVAL SYSTEM FOR JET DRIVE WATER INTAKE

CROSS REFERENCE TO RELATED APPLICATION

The present application claims the priority benefit of U.S. provisional patent application Ser. No. 60/871,197, filed Dec. 21, 2006, entitled "FOULING REMOVAL SYSTEM FOR JET DRIVE WATER INTAKE" of the same named inventor. The entire contents of that prior application are incorporated herein by reference.

BACKGROUND OF THE INVENTION

1. Field of the Invention

The present invention relates to the removal of fouling materials such as seaweed and eel grass that can clog the intakes of jet drives. More particularly, the present invention relates to fouling removal systems for watercraft jet drives. The present invention is a system to remove fouling from the jet drive intake grate and impeller.

2. Description of the Prior Art

Watercraft have traditionally been, and primarily are, propelled through water by propellers. An alternative propulsion mechanism gaining interest is the water-jet drive. Water-jet drive systems provide a number of advantages over propeller-driven systems. They eliminate a number of support and attachment components, such as rudders, propeller shafts, propellers, that increase vessel drag and limit shallow water passage. Moreover, they are safer for people and marine life in proximity to the stern of the vessel in that the moving parts are located within the hull envelope. They also tend to be quieter than propeller systems and maneuverability is enhanced at all speeds. Water-jet drives also tend to provide increased fuel economy. For these and other reasons, the water-jet drive has become increasingly popular as a watercraft propulsion system.

Water-jet drive systems propel watercraft by rapidly accelerating a relatively small volume of water over a distance. This is accomplished using one or more impeller stages located within the watercraft hull. The impeller includes a plurality of blades confined in a housing. Rotation of the impeller blades draws water into an intake of the housing, past the blades, and through an outlet at the stern. The housing is ordinarily designed to direct flow such that the water is expelled above the waterline of the watercraft. The housing may be tapered toward the outlet to increase water acceleration and maximize thrust. Improved propulsion efficiency occurs when there is a close fit between the ends of the impeller blades and the interior of the housing.

An important aspect in the effective operation of the water-jet drive is the availability of an adequate supply of water to be expelled from the housing outlet. For that reason, in general, a larger intake is desirable as it ensures a greater water supply available to the impeller to generate thrust. On the other hand, a large intake allows the impeller to draw debris in with the water. It is desirable to minimize debris contact with the impeller, which debris may damage or destroy the blades or simply clog the impeller and halt blade rotation. It is therefore useful to avoid or minimize drawing into the housing debris of any size or type that will cause damage or fouling of the impeller while keeping the intake as open as possible.

Manufacturers of watercraft using water-jet drives place intake grates at the housing intake to catch relatively large-sized debris and prevent such debris from reaching the impeller. In relatively clear water, these grates serve their purpose adequately. However, when the watercraft passes through patches of heavy debris—seaweed and eel grass in particular—the grate is overwhelmed and the intake is substantially blocked. In other instances, this type of debris or fouling passes through the grate and then sticks to the front leading edges of the blades of the impeller within the housing. Either type of fouling results in a substantial reduction of thrust capability and corresponding slowing or halt to movement of the watercraft. Unexpected substantial slowing or halting of the watercraft can be a serious safety issue for the watercraft operator and occupants, dependent upon sea conditions, weather and location.

Water-jet drive watercraft operators resolve such fouling problems in several ad hoc ways. First, they may reverse the direction of rotation of the impeller to force the fouling to move away from the intake in the hope that it will be dislodged from the grate. Second, they attempt to access the housing through an observation port below the deck and try to pull out any fouling contained therein. Third, they may be forced to jump into the water, swim under the watercraft, and pull the fouling away from the grate by hand. These options are either ineffective or an undesirable way to solve the problem. Examples of described devices can be found in U.S. Pat. Nos. 6,482,055; 6,183,319; and 6,083,063. However, these devices and the ad hoc techniques described above fail to address adequately the problem of fouling removal in water-jet drives. Worse, these ad hoc methods and described devices require that the watercraft be completely stopped before they can be performed or used. Therefore, not only are they ineffective at removing debris, they interrupt an otherwise enjoyable sail. When they must be performed or used repeatedly, which is often the case, given their ineffectiveness, the sailing experience can be ruined entirely. In order to reverse the impeller to "back-flush" the water-jet drive housing in the hope of dislodging the debris on the grate, it is necessary to have a transmission coupled to the impeller to effect that reversal. The transmission is a costly and heavy component that must also be maintained. It would be preferable to avoid addition of a transmission for the purpose of changing impeller rotation.

What is needed is a system capable of removing fouling materials from the intake of a water-jet drive. What is also needed is a fouling removal system that may be incorporated into existing water-jet drive structures and that may be incorporated into new construction. Further, what is needed is a fouling removal system that may be operated automatically using a control device in proximity to other control devices of the watercraft. Still further, what is needed is a fouling removal system that does not require the inclusion of a transmission to enable impeller rotation changes. Yet further, what is needed is a fouling removal system that includes a secondary mechanism for removing debris fouling the impeller blades of a water-jet drive. Even further, what is needed is a fouling system that is capable of removing debris from the intake grate and impeller of a water-jet drive while a watercraft is stationary or is operating at any speed, including full speed.

SUMMARY OF THE INVENTION

It is an object of the present invention to provide a system capable of removing fouling materials from the intake of a water-jet drive and impeller. It is also an object of the invention to provide a fouling removal system that may be incorporated into existing water-jet drive structures and that may be incorporated into new construction. Further, it is an object of the present invention to provide a fouling removal system that may be operated automatically using a control device in proximity to other control devices of the watercraft. Still further, it is an object of the present invention to eliminate the need for an impeller transmission for the purpose of clearing a fouled grate. Yet further, it is an object of the present invention to provide a fouling removal system that includes a secondary mechanism for removing debris fouling the impeller blades of a water-jet drive. Still further, what is needed is a fouling system that is capable of removing debris from the intake grate and impeller of a water-jet drive while a watercraft is stationary or is operating at any speed, including full speed.

These and other objects are achieved with the present invention, which is a fouling removal system for cutting away seaweed, eel grass, and other similar types of stringy or otherwise clinging debris from the intake of a water-jet drive. The fouling removal system includes a cutting arm associated with the intake grate and an actuation apparatus to actuate the cutting arm in an arc across all, or substantially all, of the surface of the intake grate. The system further includes a housing within which the cutting arm resides when not in use. The housing smoothes hydrodynamic water flow across the intake grate. The cutting arm includes at least one cutting surface, but preferably includes two cutting surfaces and there may be a third related cutting surface. Specifically, the cutting arm may include a forward cutting surface and a rearward cutting surface. Additionally, there may be a shear plate adjacent to a position of the cutting arm after actuation, which shear plate may provide a secondary cutting surface as the cutting arm passes along it. One or more cutting surfaces may be formed of a carbide material. The actuation apparatus may be, but is not limited to being, a hydraulic arm coupled to a hydraulic pump through flexible piping. The hydraulic pump may be part of a hydraulic system servicing other functions of the watercraft.

The actuation apparatus of the fouling removal system further includes an electronic controller mechanism coupled to the hydraulic arm directly or through the hydraulic pump. The controller mechanism includes an activator, such as a switch or a button coupled to circuitry that is electronically coupled to the hydraulic arm or the pump. The activator may be manipulated manually by the watercraft operator when desired to cause movement of the cutting arm. The activator may be activated periodically, sporadically, or at any time when a reduction in pressure is observed in the performance of the water-jet drive. The controller mechanism may optionally be coupled to the pressure gauge of the water-jet drive system and activated automatically when the pressure of the water-jet drive reaches a specified level indicating a reduction in water intake.

The fouling removal system also includes an optional cutter stud located within the housing adjacent to each impeller. The cutter stud includes a sharpened surface at least at its leading edge. The cutter stud is affixed to the interior of the housing near the impeller blade such that any debris buildup on the leading edge of the impeller blades contacts the sharpened surface and is cut into pieces to pass through the impeller. The cutter stud may be a standalone component or may be used in addition to the actuated cutting arm.

The fouling removal system of the present invention enables the removal of fouling materials from the intake grate of a water-jet drive. The fouling removal system also optionally enables the removal of fouling materials on, or adjacent to, the impeller of a water-jet drive. Removal of these fouling materials from the water-jet drive intake grate and impeller may be effected while the watercraft is stationary or is moving at any speed, including full speed. The present invention may be incorporated into the control functions of the watercraft. The actuation system of the invention may be incorporated into hydraulic supply arrangements existing in the watercraft.

The fouling removal system permits a watercraft operator to remove fouling at the intake grate without manual removal action. It cuts away the debris to ensure that it will not remain on the grate. The system provides a further advantage for the watercraft owner. Whereas the existing arrangement may require the owner to couple a transmission to the impeller to enable backflushing of the water-jet drive, the present invention does not require inclusion of an impeller transmission for fouling removal purposes. Additionally, the present invention substantially and efficiently keeps the water-jet drive housing clear of debris so that the watercraft remains fully operational and is not suddenly and unexpectedly incapacitated when passing through seaweed. That enhances watercraft safety.

These and other advantages of the present invention will become apparent upon review of the following detailed description, the accompanying drawings and the appended claims.

DETAILED DESCRIPTION OF THE PREFERRED EMBODIMENT

Figure 1:
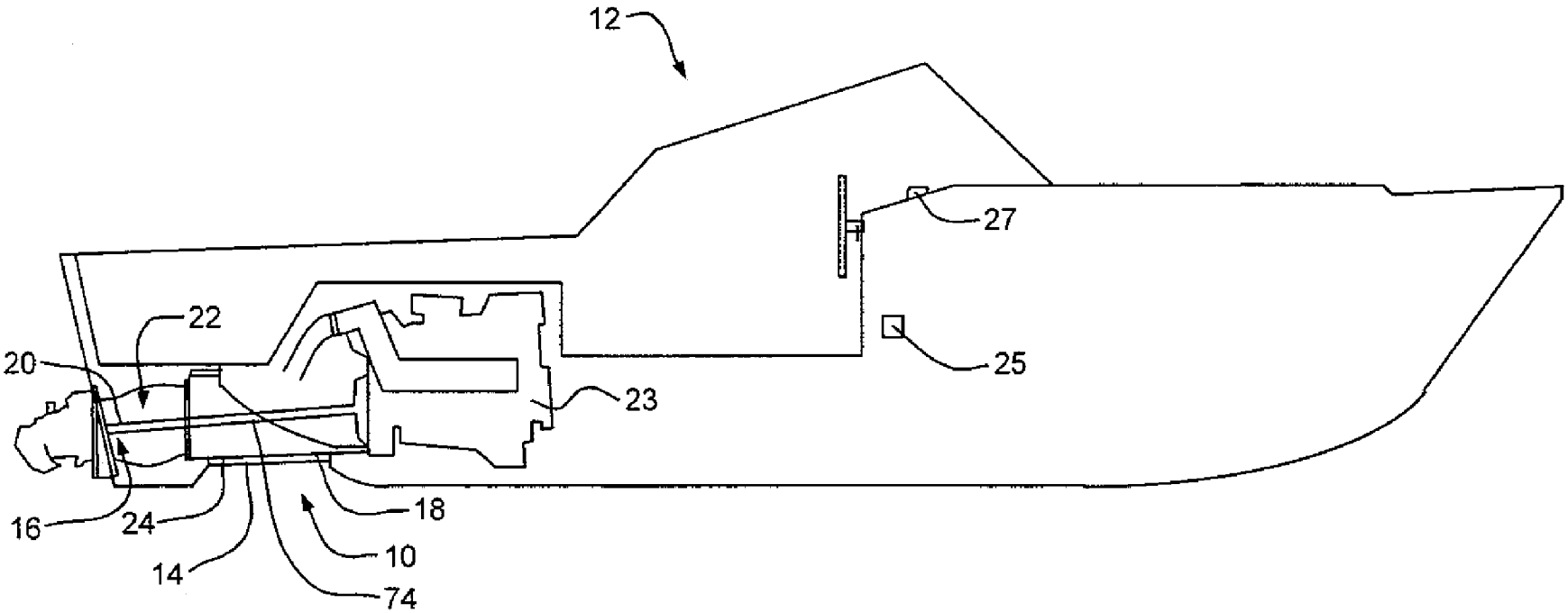
FIG. 1 is an elevation view of a watercraft including the fouling removal system of the present invention.

The present invention is a fouling removal system for removing debris such as seaweed, eel grass, or the like, from the intake grate of a water-jet drive system of a watercraft while the watercraft is stationary or is operating at any speed, including full speed. With reference to FIG. 1, the fouling removal system 10 is shown in position with respect to a watercraft 12. The fouling removal system 10 includes a cutter arm system 14 and, optionally, a cutter stud 16. The fouling removal system 10 is designed to cut away debris clogging an intake grate 18 and/or an impeller 20 within a housing 74 of the water-jet drive system 22. The water-jet drive system 22 is coupled to an engine 23. The cutter arm system 14 is coupled to a hydraulic pump 25 and is may be automatically actuated using a control switch 27. In a preferred embodiment of the present invention, the fouling removal system 10 includes the intake grate 18 having frame 24. In this arrangement, the fouling removal system 10 includes a grate assembly to be described with reference to FIGS. 2 and 3. Alternatively, the fouling removal system 10 does not include a grate assembly, but instead may be affixed to an existing grate 18.

Figure 3:
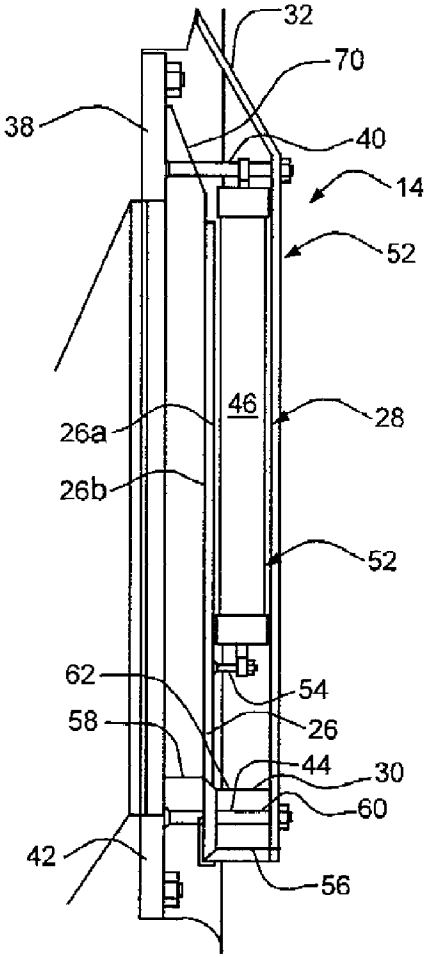
FIG. 3 is a side view of the cutter arm system.
Figure 2:
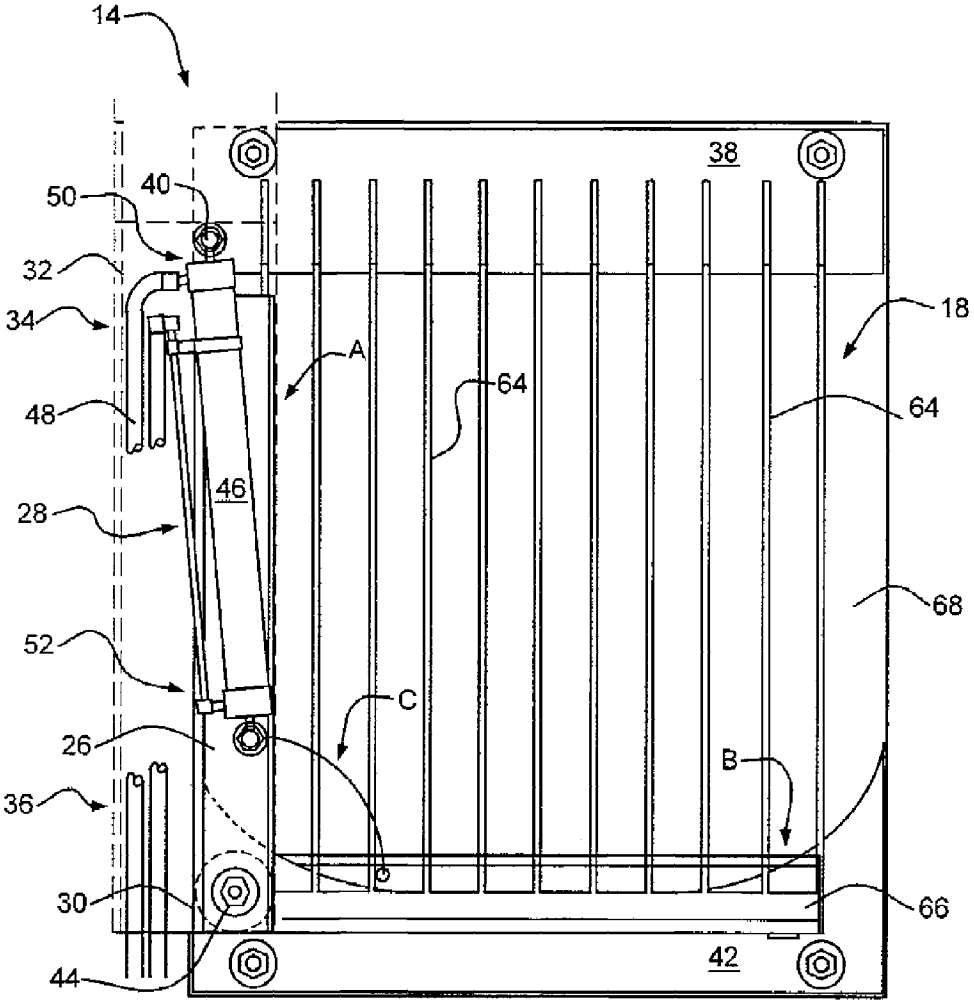
FIG. 2 is a plan view of the cutter arm system of the fouling removal system of the present invention.
Figure 6:
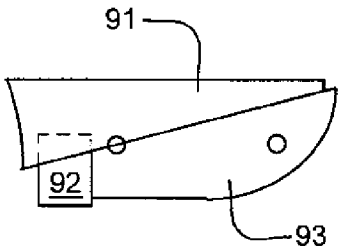
FIG. 6 is a first side view of the cutter stud of FIG. 4.
Figure 7:
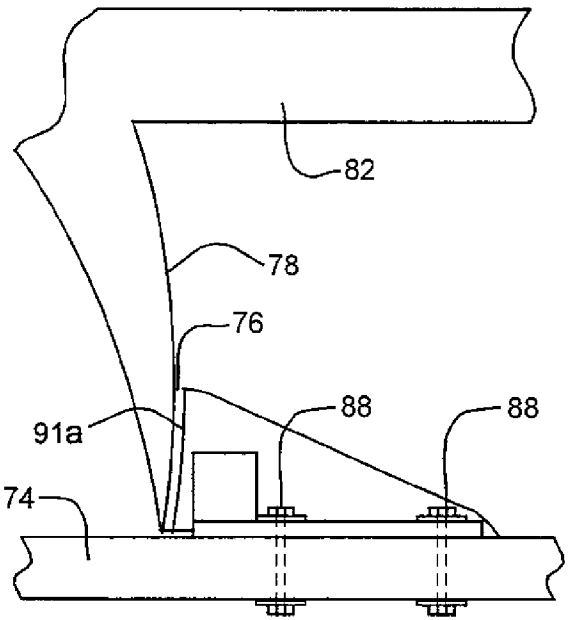
FIG. 7 is a second side view of the cutter stud of FIG. 4 affixed to the water-jet drive housing interior in close proximity to a blade of the impeller.
Figure 5:
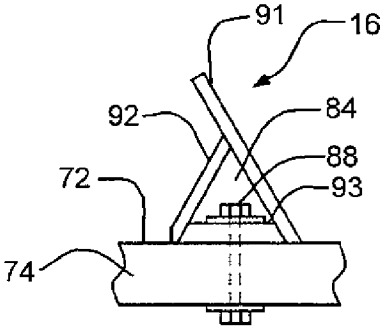
FIG. 5 is a second, close up front view of the cutter stud of FIG. 4 affixed to the water-j et drive housing interior.
Figure 4:
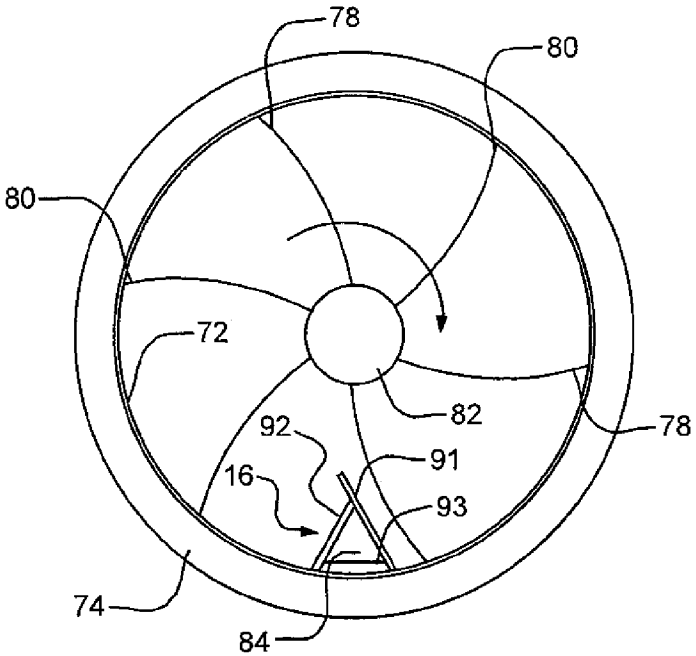
FIG. 4 is a first front view of the cutter stud of the present invention affixed to the water-jet drive housing interior.

As illustrated in FIGS. 2 and 3, the cutter arm system 14 includes a blade 26, an actuation system 28, a pivot assembly 30, and a blade housing 32. The blade 26 includes a first surface 26*a* and a second surface 26*b*. The blade 26 is shown at a first position A retracted within the blade housing 32 and in a second position B extended out of the blade housing 32. The cutter arm system 14 includes a forward end 34 and a rear end 36. The forward end 34 is removably affixed to a forward mounting plate 38 of the frame 24 using first bolt 40. The rear end 36 is removably affixed to a rear mounting plate 42 of the frame 24 using second bolt 44. The blade housing 32 is affixed to the forward mounting plate 38 using the first bolt 40 and to the rear mounting plate 42 using the second bolt 44. The cutter arm assembly 14 is preferably mounted exterior to the intake grate 18 but is not limited thereto. It is to be understood that other means for joining the cutter arm assembly 14 to the watercraft 12 at the intake of the water-jet drive system may be employed without deviating from the basic functionality of the cutter arm assembly 14.

The actuation system 28 includes a hydraulic cylinder 46 removably connected to the forward mounting plate 38 and the blade 26, and hydraulic fluid transport means, such as flexible piping 48, coupled to the hydraulic pump 25. The hydraulic cylinder 46 includes a first end 50 and a second end 52. The first end 50 is engaged with the first bolt 40 and is therefore fixedly connected to the forward mounting plate 38. The second end 52 is affixed to the blade 26 at the first surface 26*a* with a blade bolt 54. The hydraulic cylinder 46 is arranged to be positioned between the blade 26 and the blade housing 32 when the blade 26 is in retracted position A. The hydraulic cylinder 46 is sized and arranged to provide sufficient force to cause movement of the blade 26 when actuated by operation of the hydraulic pump 25. It is to be understood that other means may be used for joining the hydraulic cylinder 46 to the forward mounting plate 38 and the blade 26.

With continuing reference to FIGS. 2 and 3, the pivot assembly 30 includes a housing bushing 56 in rotatable engagement with the second bolt 44 and a mounting bushing 58 affixed to the rear mounting plate 42 and to the housing bushing 56. The housing bushing 56 includes a first end 60 rotatably coupled to an interior surface of the blade housing 32 and a second end 62 removably coupled to the first surface 26*a* of the blade 26. The housing bushing 56 is shown having male threading at the first end 60 and the second end 62 as the means for engagement with the blade housing 32 and the blade 26, but is not limited thereto. The housing bushing 56 is preferably fixedly engaged with the blade such that they rotate in unison when the blade 26 is moved by operation of the hydraulic cylinder 30.

When the watercraft 12 is functioning as expected and there are no apparent indications of reduced efficiency of the water-jet drive system 22, the actuation system 28 is dormant and the blade 26 is retracted within the housing 32. When the watercraft operator detects a reduction in efficiency of thrust, the actuation system 28 may be activated through switch 27 to cause the extension of the hydraulic cylinder 46 out of the blade housing 32 such that the second end 52 moves along a path identified as path C. The movement of the hydraulic cylinder 46 along path C causes the blade 26 affixed thereto to swing out of the blade housing 32 in an arc from position A to position B. In doing so, the blade 26 at second surface 26*b* passes in close proximity to or flush against tines 64 of the intake grate 18. The second surface 26*b* may be sufficiently sharpened to ensure that all debris located on the tines 64 is severed and allowed to pass either into the housing 74 of the water-jet drive system 22 (shown in FIG. 1) or below, and therefore completely removed from, the watercraft 12. Additionally, the first surface 26*a* of the blade 26 may be sufficiently sharpened to enable cutting through the debris. Further, a shear plate of the grate 18 may be similarly sharpened so that as blade 26 approaches it upon actuation, the blade and shear plate produce a scissoring effect to shear off debris located on the grate 18. It is to be noted that one or more portions or all parts of the cutting components of the fouling removal system 10 may be carbide. The movement of the blade 26 may be reversed such that it swings back across the tines 64 into the blade housing 32 by continued activation of the actuation system 28. The process may be repeated as desired until a return to expected water-jet drive system 22 efficiency is observed.

As shown in FIGS. 2 and 3, the fouling removal system 10 includes intake grate 18 having relatively narrow tines 64 as compared to existing grate tines. The narrow tines 64 are arranged to ensure maximum available water flow through to the water-jet drive impeller or impellers while maintaining a mechanism for capturing fouling debris such as seaweed and eel grass. The intake grate 18 is preferably a unitary device including a flange 66 from which the tines 64 extend across intake opening 68. The flange 66 forms an integral part of and connection to the rear mounting plate 42. Each of the tines 64 may also include a tapered end 70 at forward end 34 in conjunction with forward mounting plate 38. Alternatively, the fouling removal system 10 may be affixed to an intake grate supplied by the original equipment manufacturer. In that case, the forward mounting plate 38 and the rear mounting plate 42 would be affixed to the perimeter of the existing intake grate and the blade position in relation to the tines of the intake grate adjusted as necessary.

The fouling removal system 10 of the present invention may further include the optional cutter stud 16, which is shown in a specific example in FIGS. 4-7. The cutter stud 16 of the specific example has three members, a first member 91, a second member 92, and a third member 93. The first member 91, second member 92, and third member 93 are connected to, or are integral with, each other and form a triangular conduit 84. In this arrangement, the cutter stud 16 is substantially hollow. The cutter stud 16 is removably affixable at third member 93 to interior surface 72 of the housing 74 of the water-jet drive system 22 in close proximity to the impeller 20 at the upstream side thereof. For example, third member 93 of the stud 16 may be removably affixed to the interior surface 72 by using a threaded bolt 88. The substantially hollow design of the stud 16 allows maximum flow of water through the stud 16 to the impeller 20. The cutter stud 16 may be used in combination with the cutter arm system 14 or it may be a stand-alone device. It is arranged to remove debris stuck or attached to the impeller 20 and carried around as the impeller 20 rotates. The cutter stud 16 is therefore suitable for maintaining maximum efficiency of the impeller 20 itself. This also generally translates into enhancing the overall fuel efficiency of the water-jet drive system 22 and, as a result, the watercraft 12.

The cutter stud 16 includes a sharpened cutting edge 76 on end 91*a* of the first member 91 by which blades 78 of the impeller 20 pass as they rotate. The cutting edge 76 may include carbide. The first member 91 is preferably shaped on end 91*a* to match the profile of the impeller 20 and is sloped at its forward location to minimize water flow disruption. Further, the narrow profile of the cutter stud 16 substantial hollowness established by the arrangement of the members also minimizes water flow disruption. Overall, this arrangement ensures that any debris stuck to the blades 78, between blade tips 80 and/or the interior surface 72 of the housing 74, contacts the cutting edge 76 and is severed such that it will pass through the impeller 20 in relatively small pieces. The cutter stud 16 is preferably of a length sufficient to extend near to the hub 82, but is not limited to that length and may therefore be shorter.

It is to be understood that the cutter stud 16 may be attached in other ways or may be permanently attached to the housing 74. For example but in no way limited thereto, the threaded bolt 88 may be formed integrally with one or members of the stud 16, such as third member 93, and thereby either minimally intrude into triangular conduit 84, not extend at all into that space. It is also to be understood that the stud 16 is not limited to the design of the specific example, and therefore the stud 16 may be alternatively arranged in any reasonably equivalent form thereof with the goal of minimizing adverse impact on water flow through the housing 74. For example but in no way limited thereto, the stud 16 may be fabricated as a single integral piece. For relatively smaller water-jet drives, the second member 92 may be omitted, whereas for relatively larger water-jet drives, the second member 92 may be included as a structural support member of the stud 16. That is, for relatively smaller water-jet drives, the stud 16 would not be a triangular shape but, instead, an angularly shaped piece. If fabricated as a single piece, and optionally including the attachment component such as bolt 88 also as an integral piece, the cutter stud 16 would likely have no individual component able to vibrate, shake loose or break off.

The components of the fouling removal system 10 may be selected based upon the environment within which they will perform, ease of manufacture, durability, compatibility with other components of the watercraft 12 and pricing. For example, one or more of the components may be made of nonmetallic materials. In addition, one or more components may be fabricated of metallic materials. In the preferred embodiment of the present invention, the components of the fouling removal system 10 are made of a corrosion-resistant material, such as stainless steel, and cutting surfaces may include carbide. The hydraulic cylinder 46 may be of the type generally commercially available and known to those skilled in the art. The hydraulic cylinder 46 may be joined to manually operable or automatically operable hydraulic pumps or other hydraulic fluid supply means in a manner well understood by those skilled in the art.

The fouling removal system 10 of the present invention including the cutter arm system 14 and the optional cutter stud 16 enable the operator of a watercraft having a water-jet drive system 22 to remove fouling debris from the intake grate 18, the impeller 20, or both when a reduction in operating efficiency is observed. The operator may conduct such removal quickly and conveniently without going through the ad hoc manual steps previously described. No impeller transmission is required to effect debris removal. The operation of the watercraft is generally safer as sudden unexpected slowing or halting of the watercraft as a result of debris clogging of the intake is quickly and easily eliminated. The present invention has been described with respect to various combinations of preferred components. Nevertheless, it is to be understood that various modifications may be made without departing from the spirit and scope of the invention as described by the following claims.

What is claimed is:

1. A fouling removal system to aid in the removal of debris from the intake of a water jet drive of a watercraft, wherein the water jet drive includes a housing with an impeller therein, and wherein the intake includes a grate having a grate frame, the system comprising:

a. an actuator, wherein the actuator includes a hydraulic arm that is connectable to the grate frame; and b. a blade connected to the actuator, wherein the blade is arranged to pass along the grate upon actuation of the actuator.

2. The system as claimed in claim 1 further comprising a housing connectable to the grate frame, wherein the housing is arranged to store therein the blade out of the path of water flow into the intake.

3. The system as claimed in claim 1 wherein the actuator includes a pivot assembly, wherein the hydraulic arm is affixed to the blade and to the grate frame, and wherein the pivot assembly includes a bolt around which the blade pivots upon actuation of the hydraulic cylinder.

4. The system as claimed in claim 3 further comprising a controller coupled to the hydraulic arm to control actuation of the hydraulic arm.

5. The system as claimed in claim 1 wherein the housing for the impeller includes an interior surface, the device further comprising a cutter stud affixable to the interior surface of the housing adjacent to the impeller, wherein the cutter stud is arranged to cut debris stuck to the impeller as the impeller rotates.

6. A fouling removal system to aid in the removal of debris from the intake of a water jet drive of a watercraft, wherein the water jet drive includes a housing with an impeller therein, the system comprising:

a. a grate having a grate frame, wherein the grate is affixable to the watercraft so that, when affixed to the watercraft, water entering or exiting the water jet drive intake must pass through the grate;

b. an actuator, wherein the actuator includes a hydraulic arm that is connectable to the grate frame; and c. a blade connected to the actuator, wherein the blade is arranged to pass along the grate upon actuation of the actuator.

7. The system as claimed in claim 6 further comprising a housing connectable to the grate frame, wherein the housing is arranged to store therein the blade out of the path of water flow into the intake.

8. The system as claimed in claim 6 wherein the actuator includes a pivot assembly, wherein the hydraulic arm is affixed to the blade and to the grate frame, and wherein the pivot assembly includes a bolt around which the blade pivots upon actuation of the hydraulic cylinder.

9. The system as claimed in claim 8 further comprising a controller coupled to the hydraulic arm to control actuation of the hydraulic arm.

10. The system as claimed in claim 6 wherein the housing for the impeller includes an interior surface, the device further comprising a cutter stud affixable to the interior surface of the housing adjacent to the impeller, wherein the cutter stud is arranged to cut debris stuck to the impeller.

11. The system as claimed in claim 6 wherein the grate includes a flange affixed to the grate frame and a plurality of tines affixed to the flange.

12. The system as claimed in claim 11 wherein each of the plurality of tines is tapered at one end thereof.

13. The system as claimed in claim 11 wherein the tines are spaced from one another to maximize water flow therebetween.

14. A fouling removal device to aid in the removal of debris from the impeller of a water jet drive of a watercraft, wherein the water jet drive includes a housing with the impeller therein, the device comprising a cutter stud affixable to the interior surface of the housing adjacent to the impeller, wherein the cutter stud is arranged to allow water flow therethrough and is arranged to cut debris stuck to the impeller as the impeller rotates.

15. The device as claimed in claim 14 wherein the cutter stud is arranged to maximize water flow therethrough.

16. The device as claimed in claim 14 wherein the cutter stud includes a first member, a second member and a third member connected together and arranged to form a triangularly shaped conduit, wherein the third member is affixable to the interior surface of the housing.

17. A fouling removal system to aid in the removal of debris clogging a water jet drive of a watercraft, wherein the water jet drive includes a water intake and a housing with an impeller therein, the system comprising:

a. a grate having a grate frame, wherein the grate is affixable to the watercraft so that, when affixed to the watercraft, water entering or exiting the water jet drive intake must pass through the grate;

b. a housing connectable to the grate frame;

c. an actuator connectable to the grate frame;

d. a blade connected to the actuator, wherein the blade is arranged to pass along the grate upon actuation of the actuator and wherein the housing is arranged to store therein the blade out of the path of water flow into the intake;

e. a cutter stud affixable to the interior surface of the housing adjacent to the impeller, wherein the cutter stud is arranged to allow water flow therethrough and is arranged to cut debris stuck to the impeller as the impeller rotates; and f. a controller coupled to the actuator.

18. The system as claimed in claim 17 wherein the actuator includes a hydraulic arm and a pivot assembly, wherein the hydraulic arm is affixed to the blade and to the grate frame, and wherein the pivot assembly includes a bolt around which the blade pivots upon actuation of the hydraulic cylinder.

19. The system as claimed in claim 17 wherein the grate includes a flange affixed to the grate frame and a plurality of tines affixed to the flange, and wherein each of the plurality of tines is tapered at one end thereof.

20. The system as claimed in claim 17 wherein the cutter stud is substantially hollow to maximize water flow therethrough.

* * * * *